US007358903B1

(12) United States Patent
Su et al.

(10) Patent No.: US 7,358,903 B1
(45) Date of Patent: Apr. 15, 2008

(54) TRIPLE-BAND EMBEDDED ANTENNA

(75) Inventors: Jia-hung Su, Tu-Cheng (TW); Hung-jen Chen, Tu-Cheng (TW); Kai Shih, Tu-Cheng (TW); Yu-yuan Wu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/730,400

(22) Filed: Apr. 2, 2007

(51) Int. Cl.
*H01Q 1/38* (2006.01)
*H01Q 11/12* (2006.01)
*H01Q 13/10* (2006.01)

(52) U.S. Cl. ..... 343/700 MS; 343/742; 343/770

(58) Field of Classification Search ..... 343/700 MS, 343/702, 742, 770, 725
See application file for complete search history.

(56) References Cited

U.S. PATENT DOCUMENTS 6,842,143 B2 * 1/2005 Otaka et al. ..... 343/700 MS
6,995,714 B2 * 2/2006 Sim et al. ..... 343/702

* cited by examiner

*Primary Examiner*—Shih-Chao Chen
(74) *Attorney, Agent, or Firm*—Rosenberg, Klein & Lee

(57) ABSTRACT

A triple-band embedded antenna includes an antenna base and a metal connecting board. A left groove, a right groove and a square opening are formed in the antenna base. A left branch is separated from the antenna base by the left groove, the left branch arranged in the outside of the left groove, a signal feed point formed in the left branch. A right branch is separated from the antenna base by the right groove, the right branch arranged in the outside of the right groove, a ground point formed in the right branch. The antenna base is for receiving or radiating the low frequency band signal. The left groove is for receiving or radiating the high frequency band signal. While the right groove coupled with the left groove, the left groove can receive or radiate another high frequency band signal, which is the third frequency band signal.

5 Claims, 2 Drawing Sheets

TRIPLE-BAND EMBEDDED ANTENNA

BACKGROUND OF THE INVENTION

1. Field of the Invention

This present invention relates to an antenna for radiating/receiving wireless signal, and more specifically to a triple-band embedded antenna operating over a wide bandwidth of frequency or over multiple frequency bands.

2. The Related Art

It is generally known that antenna performance is dependent upon the size, shape and material composition of the constituent antenna elements, as well as the relationship between certain antenna physical parameters and the wavelength of the signal radiated or received by the antenna.

As the mobile phone is popular, the mobile phone is required to be small and light. Thus, the antenna as a radiating/receiving wireless signal part of the mobile phone is needed to be small capable of radiating/receiving several bands which can be used in the mobile phone communication. Because different countries in the world are using different mobile communication systems, such as the GSM, PHS, DCS Wi-Fi or PCS communication system, different antenna are required to fit into the mobile phones.

A traditional antenna which fits in a mobile phone can only be used in one or two communication systems, so the mobile phone may not be able to be used in every country in the world.

SUMMARY OF THE INVENTION

It is therefore an object of the present invention to provide a triple-band embedded antenna, which can solve the foregoing problem.

The triple-band embedded antenna as one kind of the loop-type antenna includes an antenna base and a metal connecting board. A left groove is formed in the left of the antenna base, a left branch is separated by the left groove from the antenna base and formed the outside of the left groove. A right groove is formed in the right of the antenna base, a right branch is separated by the right groove from the antenna base and formed the outside of the right groove. The length of the left groove equals the length of the right groove. A signal feed point is formed in the front end of the left branch. A ground point is formed in the front end of the right branch. A square opening is formed along the end edge of the antenna base. The metal connecting board connects the outside edge the left branch or the right branch.

The triple-band embedded antenna is made of a metal board and electrically connected with a PCB, an insulated board is fixed between the tri-band hidden antenna and the PCB. Or the triple-band embedded antenna is made by the metal foil on one side of the PCB. The length of the antenna base equals the half wavelength of the low frequency waves which are used in the mobile phone communication, so the low frequency antenna can receive and radiate GSM900. The length of the left groove equals the high frequency waves which can be used in the mobile phone communication, then the left groove can receive of radiate DCS1800. The length of the right groove equals nearly the length of the left groove, and the right groove and the left groove are formed symmetrically in the antenna base, so the right groove resonates with the left groove while the left groove receiving or radiating wireless signal. By the groove resonating with the left groove, the left groove can receive or radiate DCS1900. The triple-band embedded antenna can receive or radiate three frequency bands of the GSM900, DCS1800 and DCS1900.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
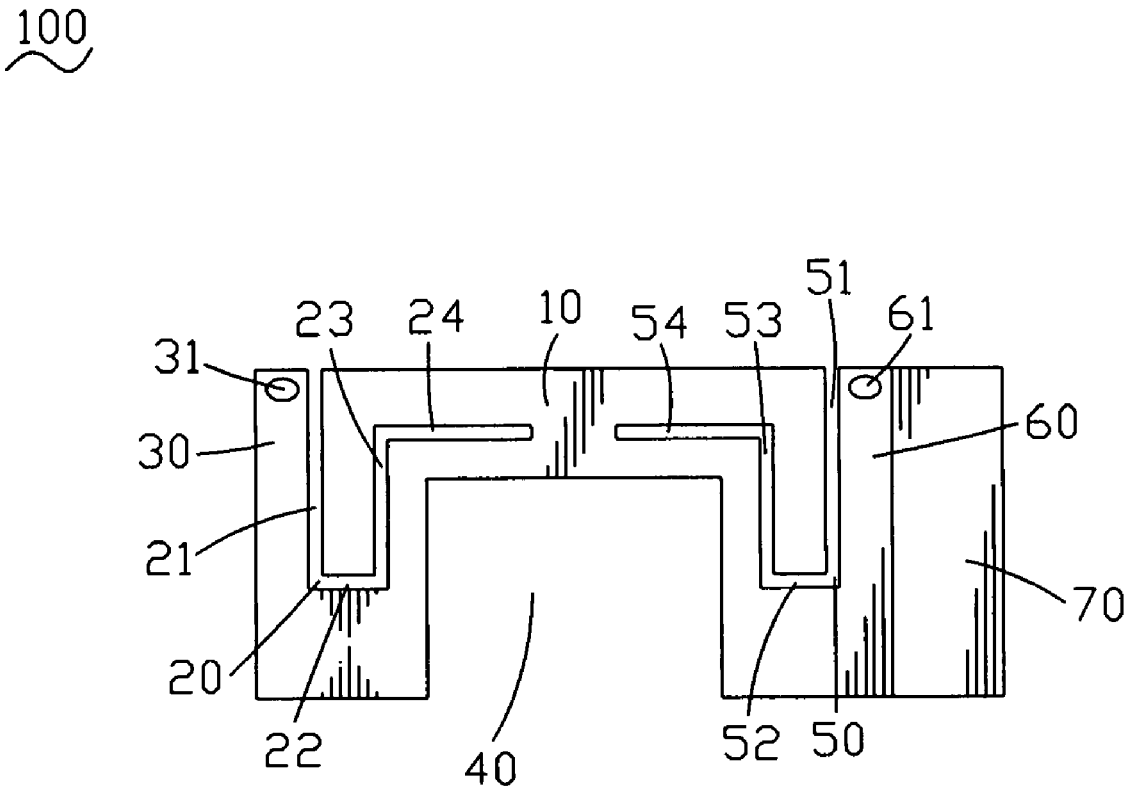
FIG. 1 is a schematic illustration of a triple-band embedded antenna according to the present invention.

Referring to FIG. 1, a triple-band embedded antenna 100 receiving or radiating three wireless frequency bands signal according to the invention is shown. The triple-band embedded antenna 100 can be made of a square metal board in this embodiment or a metal foil of a PCB. The triple-band embedded antenna 100 includes an antenna base 10 and a metal connecting board 70. A left groove 20 is formed in the left of the antenna base 10. A right groove 50 is formed in the right of the antenna base 10. A left branch 30 is separated from the antenna base 10 by the left groove 20, and the left branch 30 is located the left side of the left groove 20. A right branch 60 is separated from the antenna base 10 by the right groove 50, and the right branch 60 is located the right side of the right groove 50. A square opening 40 is formed along the end edge of the antenna base 10. The metal connecting board 70 extends from the right side of the right branch 60. A signal feed point 31 is formed in the front end of the left branch 30. A ground point 61 is formed in the right branch 60. The length of the left groove 20 equals nearly the length of the right groove 50.

The left groove 20 as a loop-type antenna is formed in the left side of the antenna base 10. The left groove 20 includes a lengthways left slot 21, a transverse left slot 22, a lengthways left notch 23 and a transverse left notch 24. The rear end of the lengthways left slot 21 connects with the left end of the transverse left slot 22. The right end of the transverse left slot 22 connects with the rear end of the lengthways left notch 23. The left end of the transverse left notch 24 connects with the front end of the lengthways left notch 23. The right end of the transverse left notch 24 is closed. The front end of the lengthways left slot 21 connects with the outside. The sum of the length of the lengthways left slot 21, the length of the transverse left slot 22, the length of the lengthways left notch 23 and the length of the transverse left notch 24 equals the half of the high frequency wavelength or equals nearly the half of the high frequency wavelength.

The left branch 30 is a troop-type metal, and formed in the outside of the lengthways left slot 21. A signal feed point 31 as signal transmitting is formed in the front end of the left branch 30, the signal feed point 31 can connected with a signal feed source formed in a mobile phone.

The right groove 50 as a loop-type antenna is formed in the right side of the antenna base 10 and symmetric with the left groove 20. The right groove 50 includes a lengthways right slot 51, a transverse right slot 52, a lengthways right notch 53 and a transverse right notch 54. The rear end of the lengthways right slot 51 connects with the right end of the transverse right slot 52. The left end of the transverse right slot 52 connects with the rear end of the lengthways right notch 53. The right end of the transverse right notch 54 connects with the front end of the lengthways right notch 53. The left end of the traverse right notch 54 is closed. The front end of the lengthways right slot 51 connects with the outside.

The right branch 60 is a troop-type metal, and formed in the outside of the lengthways right slot 51. A ground point 61 as ground is formed in the front end of the right branch 60, the ground point 61 can connected with a ground board formed in the mobile phone.

The metal connecting board 70 is a troop-type metal board, and the metal connecting board 70 is formed the outside edge of the right branch 60. The metal connecting board 70 is welded in the outside edge of the right branch 60, or the metal connecting board 70 is stretched from the outside edge of the right branch 60.

The square opening 40 located in the left inferior of the left groove 20 and the right inferior of the right groove 50 is formed in the end of the antenna base 10.

The antenna base 10 is formed by arranged the left groove 20, the right groove 50 and the square opening 40 in a metal board or a metal foil of a PCB. The total length of the antenna base 10 equals the half of the low frequency wavelength.

Figure 2:
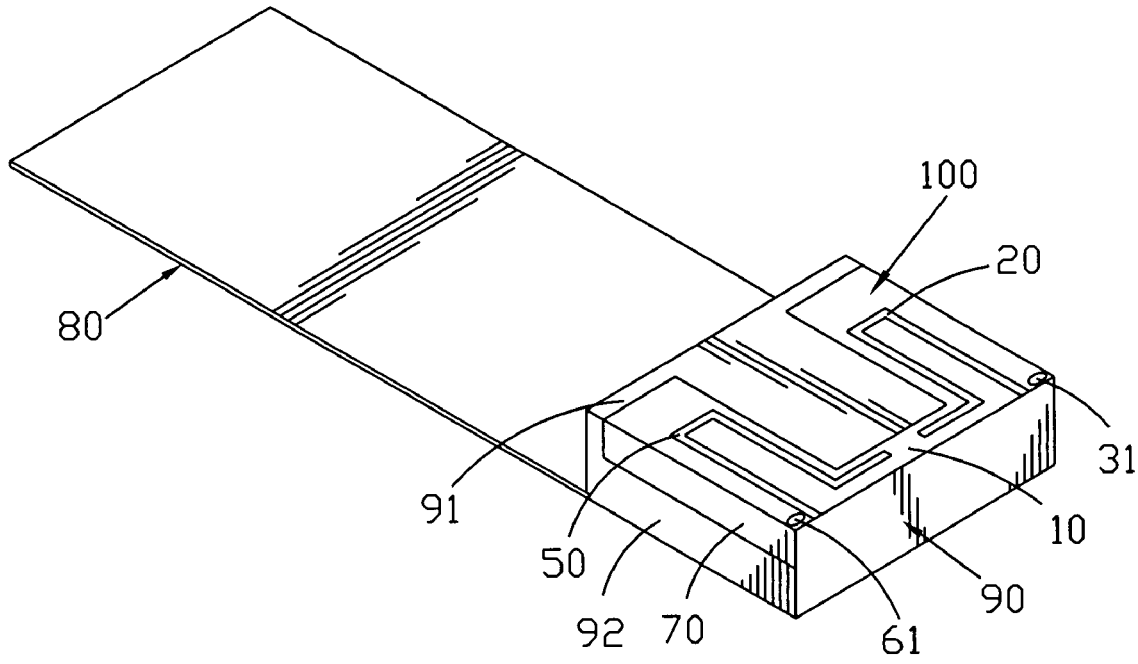
FIG. 2 is a schematic illustration showing the triple-band embedded antenna fixed on a printed circuit board.

Referring to FIG. 2, the triple-band embedded antenna 100 is located on an insulated board 90, and then the insulated board 90 is located on a PCB 80. While the triple-band embedded antenna 100 receiving or radiating wireless signal, the insulated board 90 reduces the electromagnetic interference between the tri-band antenna 100 and the PCB 80. The antenna base 10 is located on the top surface 91 of the insulated board 90. The metal connecting board 70 is bend downward and located on the side surface 92 of the insulated board 90.

While the triple-band embedded antenna 100 receiving or radiating wireless signal, the left groove 20 resonates with the wireless signal about the DCS1800. While the triple-band embedded antenna 100 receiving or radiating wireless signal, the left groove 20 coupled with the right groove 50, so the left groove 20 resonates with the wireless signal about the PCS1900. The metal connecting board 70 can be used to offset the drawback of the antenna base' area.

The antenna base 10 can be used to receive or radiate the low frequency signal, the left groove 20 formed in the antenna base 10 can be used to receive or radiate the DCS1800 signal. While the triple-band embedded antenna 100 receiving wireless signal, the right groove 50 formed in the antenna base 10 can couple with the left groove 20, so the left groove 20 can receive or radiate the PCS1900 signal.

A metal board or a metal foil of a PCB can be used to made the triple-band embedded antenna 100. The left groove 20 and the right groove 50 can exchange, the right groove 50 maybe receive or radiate the wireless signal while the left groove 20 coupling with the right groove 50.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A triple-band embedded antenna, comprising:

an antenna base having a left groove, a right groove and a square opening, the left groove formed in one side of the antenna base, a left branch separated from the antenna base by the left groove, a signal feed point formed in the left branch, the right groove formed in the other side of the antenna base, a right branch separated from the antenna base by the right groove, a ground point formed in the right branch, the square opening formed along the end edge of the antenna base; and a metal connecting board, having troop-type, formed on the outside edge of the right branch;

wherein the left groove includes a lengthways left slot, a transverse left slot, a lengthways left notch and a transverse left notch, the rear end of the lengthways left slot connected with the left end of the transverse left slot, the right end of the transverse left slot connected with the rear end of the lengthways left notch, the left end of the transverse left notch connected with the front end of the lengthways left notch, the right end of the transverse left notch be closed, the front end of the lengthways left slot connected with the outside, the left branch located in the left side of the lengthways left slot; and wherein the right groove includes a lengthways right slot, a transverse right slot, a lengthways right notch and a transverse right notch, the rear end of the lengthways right slot connected with the right end of the transverse right slot, the left end of the transverse right slot connected with the rear end of the lengthways right notch, the right end of the transverse right notch connected with the front end of the lengthways right notch, the left end of the transverse right notch be closed, the front end of the lengthways right slot connected with the outside, the right branch located in the right side of the lengthways right slot.

2. The triple-band embedded antenna as set forth in claim 1, wherein the metal connecting board extends from the outside of the right groove.

3. The triple-band embedded antenna as set forth in claim 1, wherein the length of the antenna base equals the half of the low frequency wavelength.

4. The triple-band embedded antenna as set forth in claim 1, wherein the length of the left groove equals the quarter of the high frequency wavelength.

5. The triple-band embedded antenna as set forth in claim 1, wherein the metal connecting board is formed on the outside edge of the left branch.

* * * * *